US010605576B1

(12) United States Patent
Nance et al.

(10) Patent No.: US 10,605,576 B1
(45) Date of Patent: Mar. 31, 2020

(54) DUAL MODE INITIATOR SYSTEM

(71) Applicant: Renolds Systems, Inc., Middletown, CA (US)

(72) Inventors: Nicholas Christopher Nance, Middletown, CA (US); Richard K. Reynolds, Middletown, CA (US)

(73) Assignee: Reynolds Systems, Inc., Middletown, CA (US)

( * ) Notice: Subject to any disclaimer, the term of this patent is extended or adjusted under 35 U.S.C. 154(b) by 0 days.

(21) Appl. No.: 15/784,242

(22) Filed: Oct. 16, 2017

(51) Int. Cl.
*F42B 3/10* (2006.01)
*F42B 3/12* (2006.01)
*F42B 3/13* (2006.01)

(52) U.S. Cl.
CPC ..... *F42B 3/125* (2013.01); *F42B 3/12* (2013.01); *F42B 3/124* (2013.01); *F42B 3/127* (2013.01); *F42B 3/13* (2013.01)

(58) Field of Classification Search
CPC .. F42B 3/10; F42B 3/103; F42B 3/107; F42B 3/12; F42B 3/124; F42B 3/125; F42B 3/127; F42B 3/13; F42D 1/045
USPC ..... 102/202.6
See application file for complete search history.

(56) References Cited

U.S. PATENT DOCUMENTS 3,407,732 A * 10/1968 Przybylik ..... F42B 3/124 361/248
6,584,911 B2 * 7/2003 Bergerson ..... B60R 21/264 102/530
6,709,012 B1 * 3/2004 Tanaka ..... B60R 21/017 280/736
6,848,713 B2 * 2/2005 Nakashima ..... B60R 21/2644 102/202
6,923,122 B2 8/2005 Hennings et al.
7,430,963 B2 10/2008 Hennings et al.
7,571,679 B2 * 8/2009 Nance ..... F42B 3/103 102/202.14
8,408,131 B1 * 4/2013 Nance ..... F42B 3/103 102/202.14
8,701,557 B2 * 4/2014 Biggs ..... F42B 3/125 102/202.5

* cited by examiner

*Primary Examiner* — James S Bergin
(74) *Attorney, Agent, or Firm* — Burris Law, PLLC

(57) ABSTRACT

An initiator system with a first initiator device, which has a first initiator and a first charge, and a second initiator device that has a second initiator and a second charge. At least a portion of the second charge is isolated from the first initiator device such that operation of the first initiator will not cause the isolated portion of the second charge to detonate, deflagrate or combust.

17 Claims, 6 Drawing Sheets

DUAL MODE INITIATOR SYSTEM

FIELD

The present disclosure relates to a dual mode initiator system and a related method for initiating an energetic material.

BACKGROUND

This section provides background information related to the present disclosure which is not necessarily prior art.

U.S. Pat. No. 7,430,963 discloses an initiator system that employs an exploding foil initiator to produce a shockwave output that can be employed in an explosive train to initiate detonation of a main charge. U.S. Pat. No. 6,923,122 discloses an initiator system that employs an exploding foil initiator to detonate an input charge and cause combustion or deflagration of an output charge to thereby produce a pyrotechnic output.

SUMMARY

This section provides a general summary of the disclosure, and is not a comprehensive disclosure of its full scope or all of its features.

In one form, the present disclosure provides an initiator system that includes a housing, an initiator assembly received in the housing, and first and second sets of initiator terminals. The initiator assembly includes a first initiator device and a second initiator device. The first initiator device has a first initiator and a first charge, while the second initiator device has a second initiator and a second charge. Either a) at least a portion of the second charge is isolated from the first initiator device such that operation of the first initiator will not cause the isolated portion of the second charge to detonate, deflagrate or combust, b) at least a portion of the first charge is isolated from the second initiator device such that operation of the second initiator will not cause the isolated portion of the first charge to detonate, deflagrate or combust, or c) at least a portion of the second charge is isolated from the first initiator device such that operation of the first initiator will not cause the isolated portion of the second charge to detonate, deflagrate or combust and at least a portion of the first charge is isolated from the second initiator device such that operation of the second initiator will not cause the isolated portion of the first charge to detonate, deflagrate or combust. The first set of initiator terminals is received through the housing and is electrically coupled to the first initiator. The second set of initiator terminals is received through the housing and is electrically coupled to the second initiator.

In another form, the present disclosure provides a method for operating an initiator system having a housing and an initiator assembly that is received in the housing. The initiator assembly has a first initiator device and a second initiator device. The first initiator device includes a first initiator and a first charge, while the second initiator device includes a second initiator and a second charge. The method includes: activating the second initiator to initiate at least one of detonation, combustion and deflagration in in at least a portion of the second charge; and activating the first initiator to initiate at least one of detonation, combustion and deflagration in in at least a portion of the first charge.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
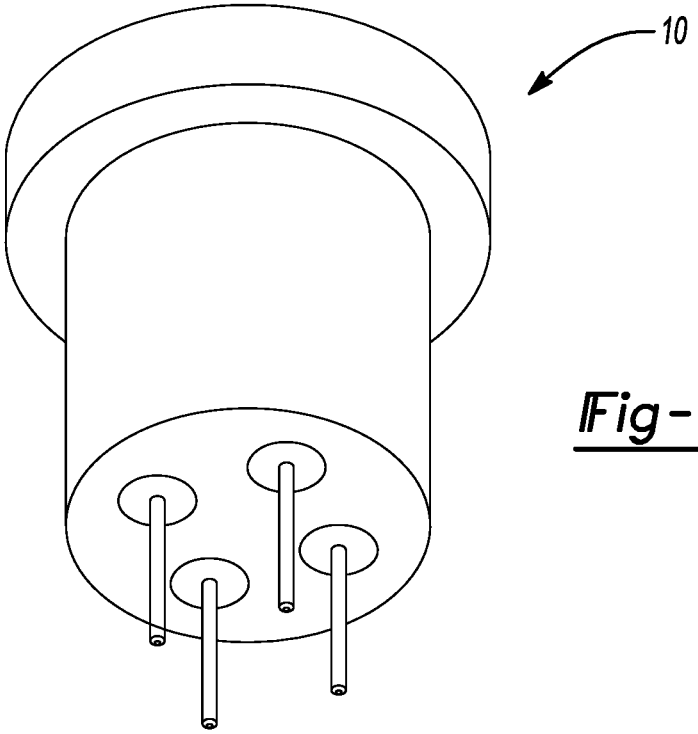
FIG. 1 is a perspective view of an exemplary initiator system constructed in accordance with the teachings of the present disclosure.
Figure 2:
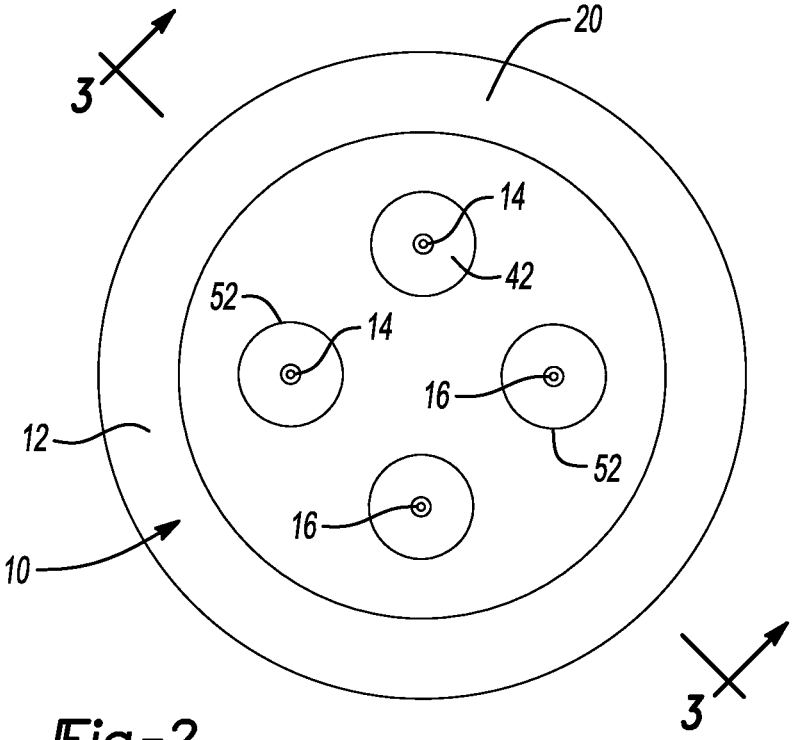
FIG. 2 is a bottom plan view of the initiator system of FIG. 1.
Figure 3:
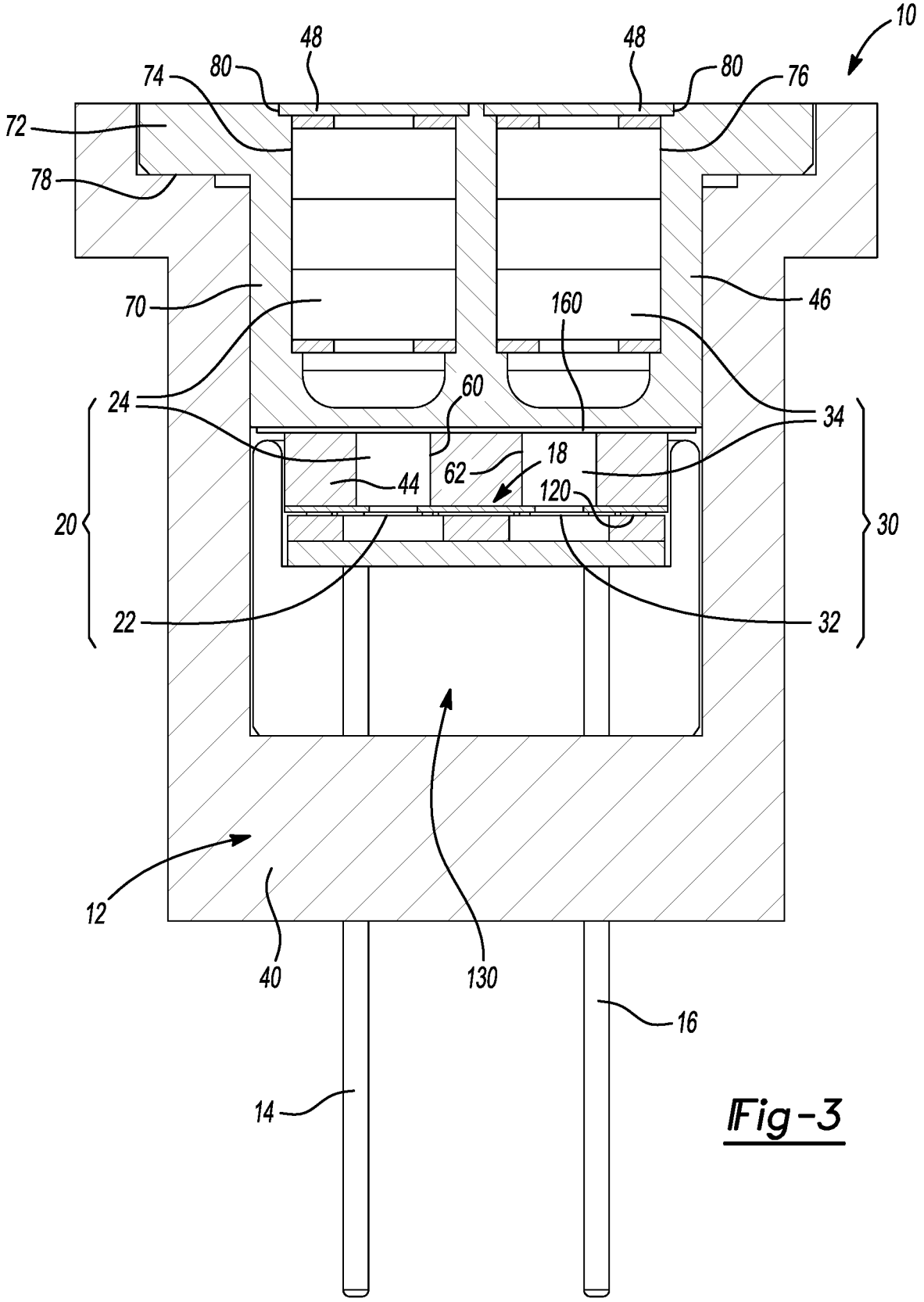
FIG. 3 is a longitudinal section view of an initiator system taken along the line 3-3 of FIG. 2.

With reference to FIGS. 1 through 3, an exemplary initiator system constructed in accordance with the teachings of the present disclosure is generally indicated by reference numeral 10. The initiator system 10 can include a housing 12, a first set of initiator terminals 14, a second set of initiator terminals 16 and an initiator assembly 18. With additional reference to FIG. 4, the initiator assembly 18 can include a first initiator device 20, which can have a first initiator 22 and a first charge 24, and a second initiator device 30 that can include a second initiator 32 and a second charge 34.

The housing 12 can be constructed in one or more pieces and can house the initiator assembly 18. In the example provided, the housing 12 comprises a shell 40, a plurality of seals 42, a first charge holder 44, a second charge holder 46 and one or more covers 48. The shell 40 can define a cavity 50 and a plurality of seal apertures 52. The cavity 50 can extend through one axial end of the shell 40 and can be sized to receive the initiator assembly 18, the first charge holder 44 and the second charge holder 46. The seal apertures 52 can extend through an end of the shell 40 opposite the cavity 50 and can intersect the cavity 50.

Each of the terminals of the first and second sets of initiator terminals 14 and 16 can be received through a corresponding one of the seal apertures 52. Each of the seals 42 can have a hollow, tubular shape and can be formed of an electrically insulating material, such as glass. Each of the seals 42 can be received in a corresponding one of the seal apertures 52 and can have an outer peripheral surface, which can be sealingly engaged to the shell 40, and an inner peripheral surface that can be sealing engaged to a corresponding one of the terminals of the first and second sets of initiator terminals 14 and 16.

Figure 4:
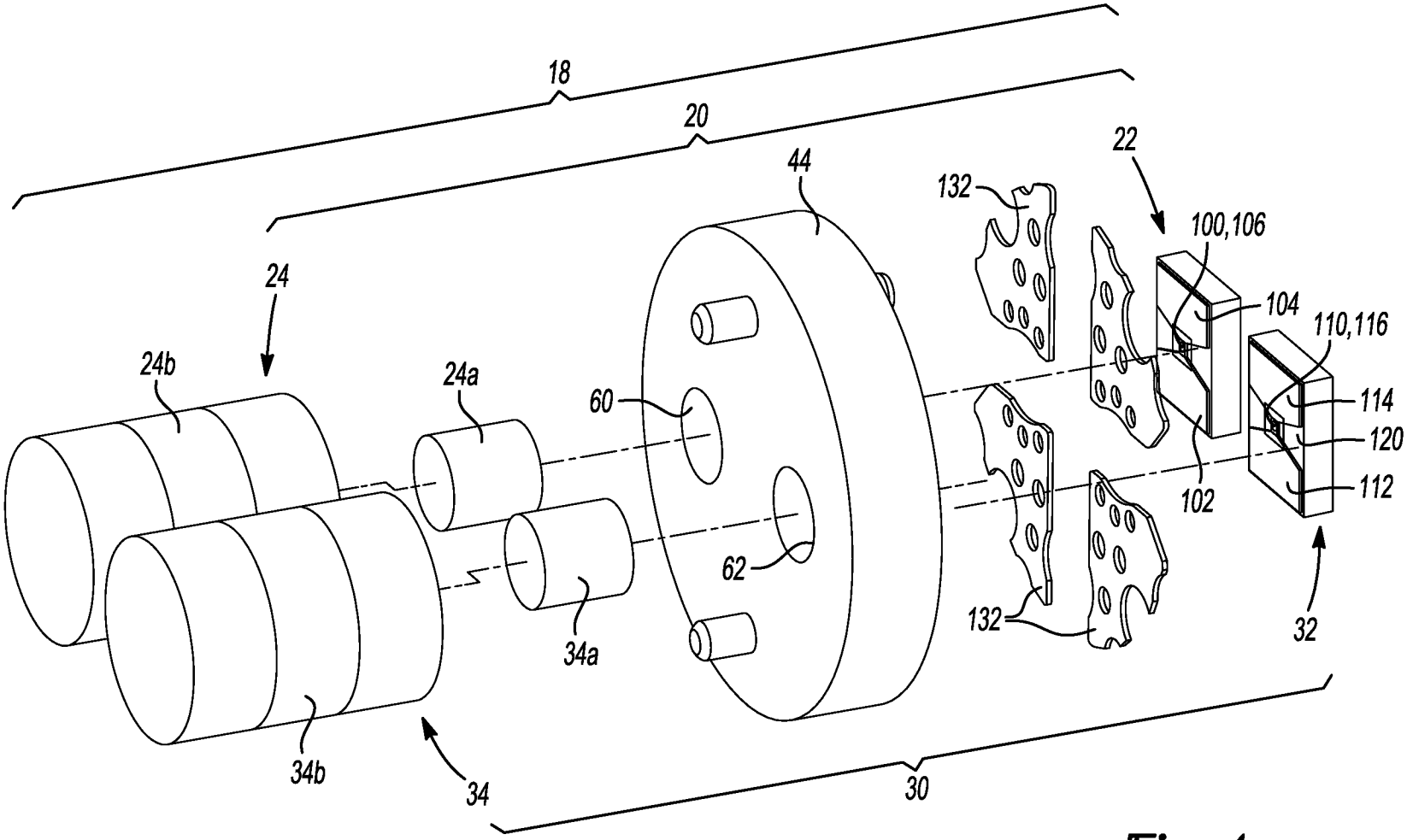
FIG. 4 is an exploded perspective view of a portion of the initiator system of FIG. 1, illustrating a portion of an exemplary initiator assembly in more detail.

With specific reference to FIGS. 3 and 4, the first charge holder 44 can be configured to hold all or a portion of the first charge 24, hold all or a portion of the second charge 34, segregate the portions of the first and second charges 24 and 34 held by the first charge holder 44 apart from one another, to position the portion of the first charge 24 held by the first charge holder 44 in a desired location relative to the first initiator 22, and/or to position the portion of the second charge 34 held by the first charge holder 44 in a desired location relative to the second initiator 32. In the example provided, the first charge holder 44 is shaped as a cylindrical disk with a first bore 60 and a second bore 62 that can be formed entirely through the first charge holder 44 and parallel to one another. If desired, the first charge holder 44 can be keyed to the shell 40 to permit the first charge holder 44 to be assembled to the shell 40 in a single, predetermined orientation.

The second charge holder 46 can be configured to hold a portion of the first charge 24, to hold a portion of the second charge 34, to segregate the portion of the first charge 24 that is held by the second charge holder 46 from the second charge 34 and/or the portion of the first charge 24 that is held by the first charge holder 44, to segregate the portion second charge 34 that is held by the second charge holder 46 from the first charge 24 and/or the portion of the second charge 34 that is held by the first charge holder 44, to position the portion of the first charge 24 that is held by the second charge holder 46 in a desired location relative to the portion of the first charge 24 that is held by the first charge holder 44 and/or to position the portion of the second charge that is held by the second charge holder 46 in a desired location relative to the portion of the second charge 34 that is held by the first charge holder 44. In the example provided, the second charge holder 46 includes a cylindrical body portion 70 and a flange member 72 that extends radially outwardly from the body portion 70. The body portion 70 can define a third bore 74 and a fourth bore 76 that can be formed partly or completely through the body portion 70 and parallel to one another. The flange member 72 can be received into a counterbore 78 in the shell 40 when the second charge holder 46 is received into the shell 40. If desired, the second charge holder 46 can be keyed to the shell 40 and/or to the first charge holder 44 to permit the second charge holder 46 to be assembled to the shell 40 and/or the first charge holder 44 in a single, predetermined orientation. The second charge holder 46 can be fixedly coupled to the shell 40 in any desired manner, such as via laser welding.

Each cover 48 can be received into a corresponding bore 80 formed in the second charge holder 46. In the example provided, a pair of covers 48 are employed, with each cover 48 being employed to hermetically seal an associated one of the third and fourth bores 74 and 76. The covers 48 can be fixedly coupled to the second charge holder 46 in any desired manner, such as via laser welding.

Figure 5:
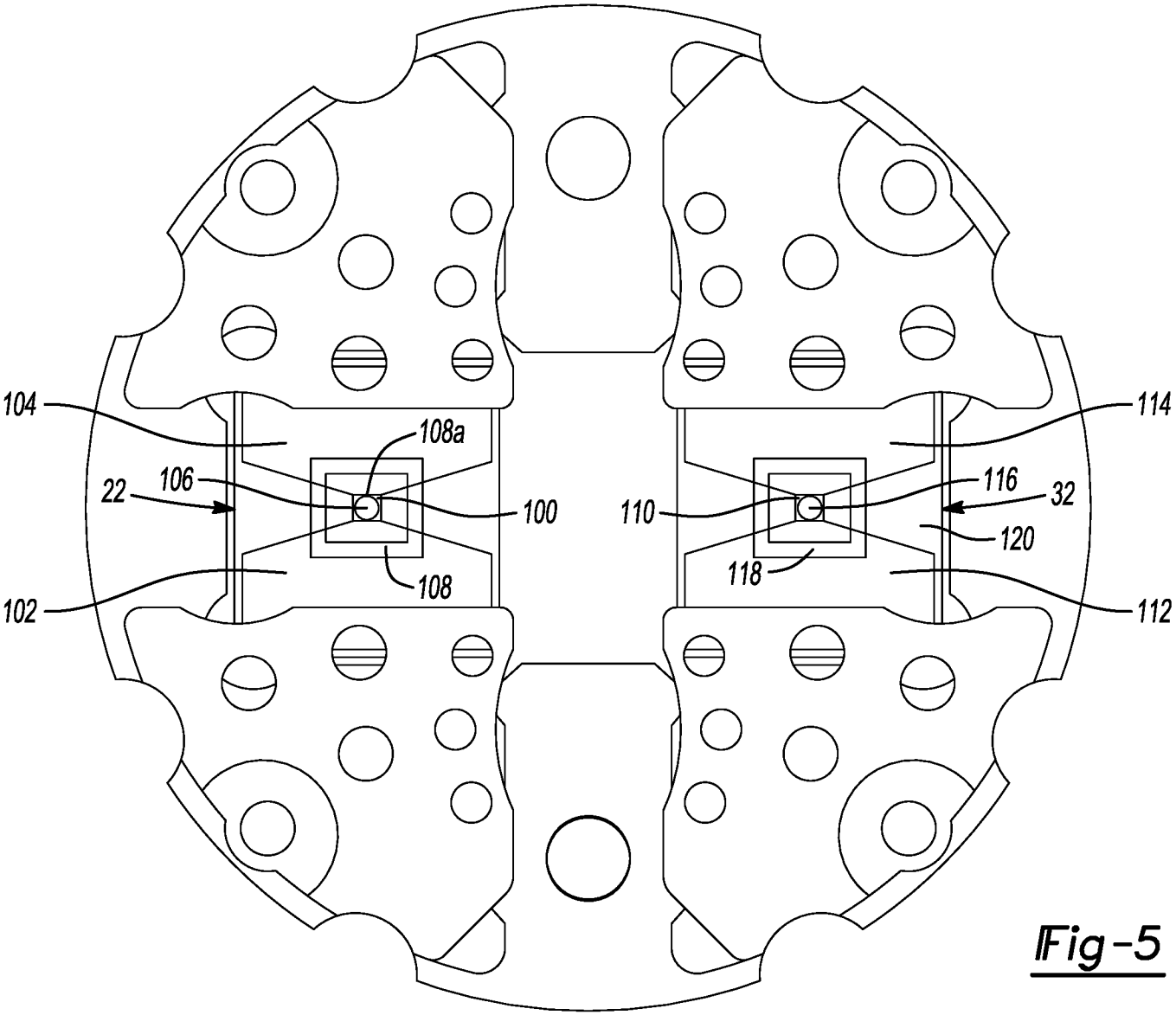
FIG. 5 is a top plan view a portion of the initiator system of FIG. 1, illustrating first and second initiators of a portion of an exemplary initiator assembly.

With reference to FIGS. 4 and 5, the first initiator 22 can be any type of device that can be configured to initiate detonation, deflagration and/or combustion in the first charge 24. For example, the first charge 24 can be formed of a suitable high explosive material, such as a secondary explosive, and the first initiator 22 can be configured to initiate detonation of the first charge 24. In the particular example provided, the first initiator 22 comprises an exploding foil initiator having a first bridge 100, first and second bridge contacts 102 and 104 that are electrically coupled to the first bridge 100, a first flyer 106, which overlies the first bridge 100, and a first barrel 108 that overlies the first flyer 106. The first bridge contact 102 can be electrically coupled to a first one of the terminals of the first set of initiator terminals 14 (FIG. 2), while the second bridge contact 104 can be electrically coupled to a second one of the terminals of the first set of initiator terminals 14 (FIG. 2).

Likewise, the second initiator 32 can be any type of device that can be configured to initiate detonation, deflagration and/or combustion in the second charge 34. For example, at least a portion of the second charge 34 can be formed of a suitable high explosive material, such as a secondary explosive, and the second initiator 32 can be configured to initiate detonation of the high explosive portion of the second charge 34. In the particular example provided, the second charge 34 includes a first portion 34*a*, which can be formed of a suitable secondary explosive, and a second portion 34*b* that can be formed of a suitable low explosive, while the second initiator 32 comprises an exploding foil initiator that can be configured to initiate detonation of the first portion 34*a* of the second charge 34. The exploding foil initiator of the second initiator 32 can have a second bridge 110, third and fourth bridge contacts 112 and 114 that are electrically coupled to the second bridge 110, a second flyer 116, which overlies the second bridge 110, and a second barrel 118 that overlies the second flyer 116. The third bridge contact 112 can be electrically coupled to a first one of the terminals of the second set of initiator terminals 16 (FIG. 2), while the fourth bridge contact 114 can be electrically coupled to a second one of the terminals of the second set of initiator terminals 16 (FIG. 2).

Figure 6:
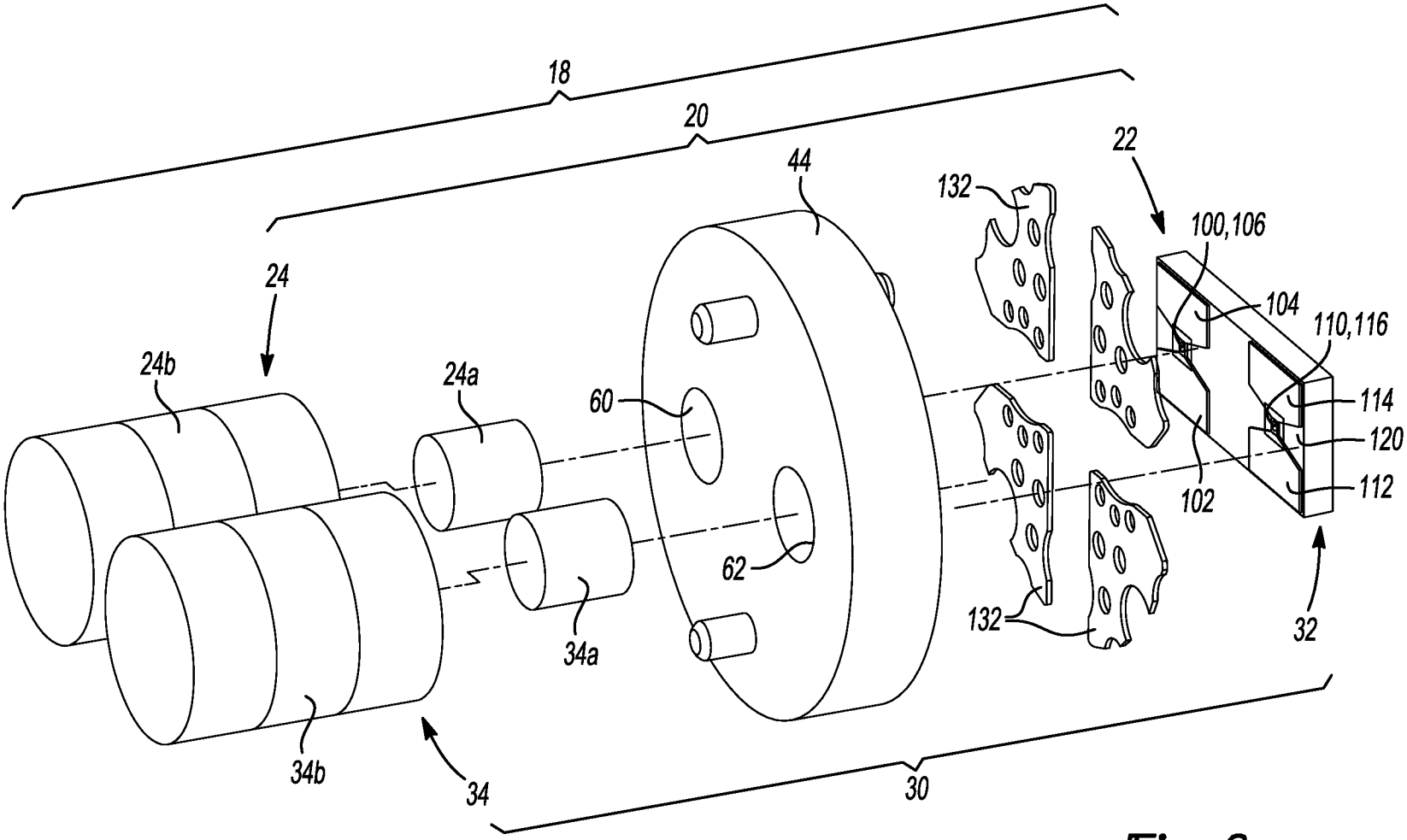
FIG. 6 is an exploded perspective view similar to that of FIG. 5 but depicting first and second initiators that are disposed on a common substrate.
Figure 7:
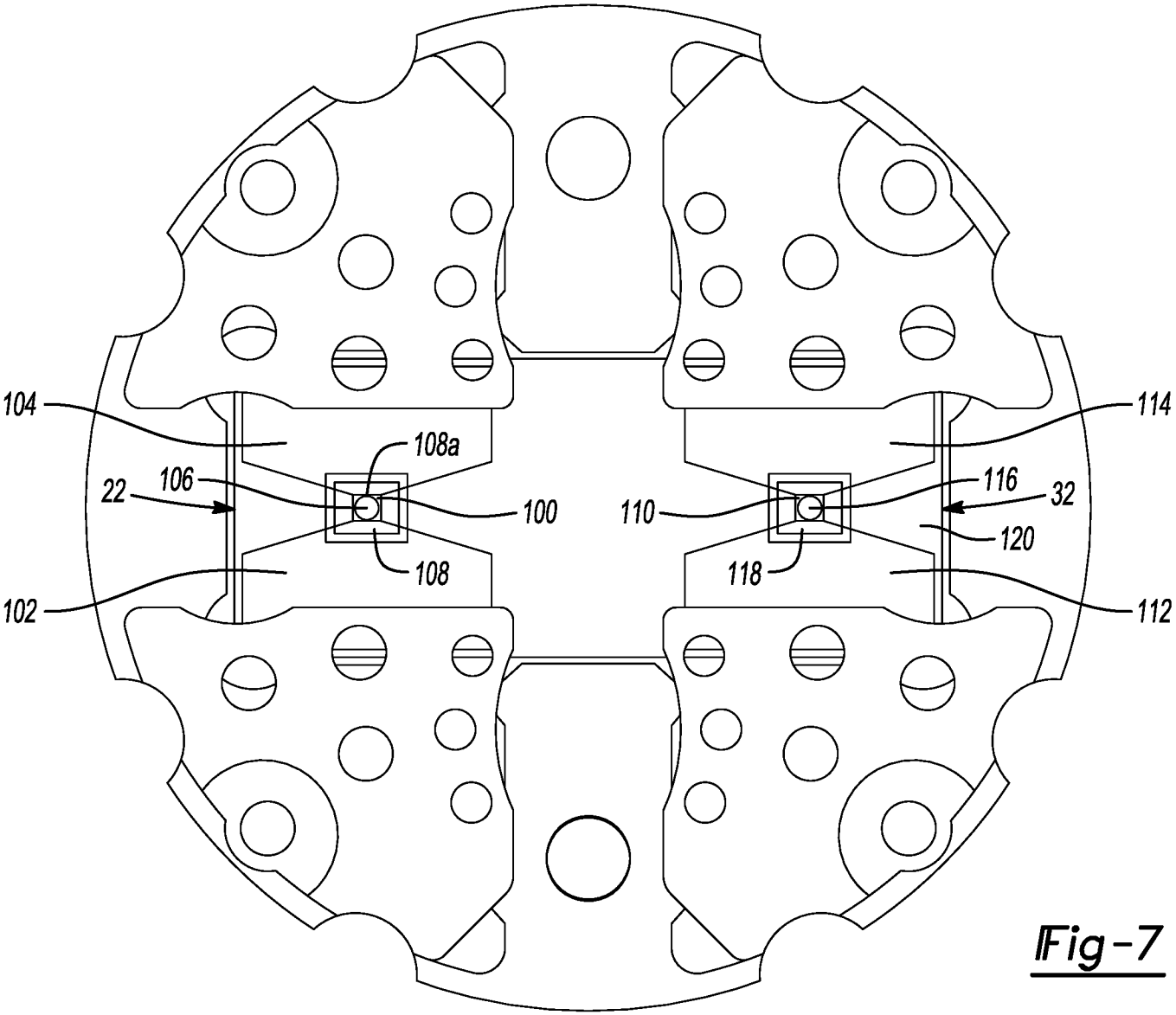
FIG. 7 is a top plan view similar to FIG. 5 but depicting first and second initiators that are disposed on a common substrate.

In the example provided, the first and second bridges 100 and 110 are individually formed onto a separate substrate to enhance the modularity of the initiator system 10. It will be appreciated, however, that the first and second bridges 100 and 110 could be formed onto a singular, unitarily formed substrate 120 (which can be formed of a suitable ceramic material) as shown in FIGS. 6 and 7.

Returning to FIGS. 4 and 5, each of the first and second charges 24 and 34 can be any type of energetic material and can include one or more high explosives, one or more low explosives, or a combination or series of one or more high explosives and one or more low explosives. In the example provided, the first charge 24 comprises a first portion 24*a*, which together with the first portion 34*a* of the second charge 32 is housed in a respective one of the first and second bores 60 and 62 formed in the first charge holder 44, and a second portion 24*b*, which together with the second portion 34*b* of the second charge 34 is housed in a respective one of the third and fourth bores 74 and 76 (FIG. 3) in the second charge holder 46 (FIG. 3).

With reference to FIGS. 3 and 4, other aspects of the initiator assembly 18 can be somewhat similar to that which is described in U.S. Pat. No. 7,450,963, which is incorporated by reference as if fully set forth in detail herein. For example, the initiator assembly 18 can further include a spacing member 130, which can be disposed between the closed end of the shell 40 and the substrate 120, and a plurality of electric contacts 132, each of which being soldered to a respective one of the terminals of the first and second sets of initiator terminals 14 and 16, and to a respective one of the first, second, third and fourth bridge contacts 102, 104, 112 and 114. Alternatively, other aspects of the initiator assembly 18 can be somewhat similar to that which is described in U.S. Pat. No. 7,571,679 or commonly assigned U.S. patent application Ser. No. 15/600,893.

Since the first and second initiators 22 and 32 are exploding foil initiators in the example provided, the first portion 24*a* of the first charge 24 and the first portion 34*a* of the second charge 34 can be configured in an identical manner.

In this regard, a suitable secondary explosive material, such as RSI-007 manufactured by Reynolds Systems, Inc. of Middletown, Calif., can be compressed into the each of the first and second bores 60 and 62 in the first charge holder 44 to form the first portion 24*a* of the first charge 24 and the first portion 34*a* of the second charge 34. If a detonation output from the initiator system 10 is desired, the first initiator 22 can be activated to initiate detonation of the first portion 24*a* of the first charge 24. Activation of the first initiator 22 entails the application of sufficient electrical energy in a relatively short amount of time to cause the first bridge 100 (FIG. 5) to vaporize. Vaporization of the first bridge 100 (FIG. 5) can shear the first flyer 106 (FIG. 5) from the layer of material to which it is attached and propel the (sheared) first flyer 106 (FIG. 5) through an aperture 108*a* (FIG. 5) of the first barrel 108 (FIG. 5) so that it impacts the first portion 24*a* of the first charge 24 with sufficient energy to initiate detonation of the first portion of the first charge 24. Energy released as the first portion 24*a* of the first charge 24 detonates can be transmitted through the second charge holder 46 and can initiate detonation of the second portion 24*b* of the first charge 24. The second portion 24*b* of the first charge 24 can be formed of the same energetic material from which the first portion 24*a* of the first charge 24 is formed. However, it will be appreciated that second portion 24*b* of the first charge 24 could be formed from a different energetic material, such as a secondary explosive that is less costly and/or less readily detonated directly by an exploding foil initiator.

In some applications, the second initiator 32 could be configured to initiate detonation of the second charge 34, and the second charge 34 could be configured so that the amount energy released from the initiator system 10 through the activation of the second initiator 32 could be different from the energy that is released from the initiator system 10 through the activation of the first initiator 22. In the example provided, however, the second initiator 32 can be activated to initiate detonation of the first portion 34*a* of the second charge 34 in a manner that is identical to that which is described above, and energy released from the first portion 34*a* of the second charge 34 is employed to initiate deflagration and/or combustion of the second portion 34*b* of the second charge 34. More specifically, a barrier 160 can be disposed between the first and second portions 34*a* and 34*b* of the second charge 34. The barrier 160 can be similar to that which is disposed in U.S. Pat. No. 6,923,142, the disclosure of which is incorporated by reference as if fully set forth in detail herein. The barrier 160 can attenuate the shockwave that is produced by the detonation of the first portion 34*a* of the second charge 34, and/or provide a material that burns in response to the high heat and pressure generated by the detonation of the first portion 34*a* of the second charge 34. Energy from the detonation of the first portion 34*a* of the second charge 34 and/or the burning of the barrier 160 can initiate deflagration and/or combustion of the second portion 34*b* of the second charge 34, which can be formed of a desired low explosive material, such as boron potassium nitrate ($BKNO_3$).

Alternatively, both the first and second initiators 22 and 32 could be activated during the operation of the initiator system 10. For example, the first and second initiators 22 and 32 could be activated simultaneously to produce a combined output. In the example provided, the combined output would consist of a shockwave and a pyrotechnic output, but it will be appreciated that by selection of the particular initiator devices used for the first and second initiator devices 20 and 30, the combined output could be configured in a desired manner. As another example, the first and second initiators 22 and 32 could be activated sequentially, with or without a time interval there between, to provide two discrete outputs. In the particular example provided, the second initiator 32 could be activated initially to generate a pyrotechnic output (e.g., to initiate combustion in a third charge (not shown) that is housed outside the initiator system 10), and the first initiator 22 could be activated subsequently to generate a shockwave output (e.g., to initiate detonation of a portion of the third charge that has not combusted). Alternatively, the first initiator 22 could be activated initially to generate a shockwave output, and the second initiator 32 could be activated subsequently to generate a pyrotechnic output.

In the above example the second charge 34 is completely segregated or isolated from the first initiator device 20, including the first charge 24. In some configurations, this can permit the output of the second initiator device 30 to be separate from the output of the first initiator device 20 so that one of the first and second initiator devices 20 and 30 can be activated without causing the charge in the other one of the first and second initiator devices 20 and 30 to undergo detonation, deflagration or combustion. It will be appreciated that a portion of the first charge 24 could be segregated or isolated from the second initiator device 30 so that operation of the second initiator device 30 would not cause detonation, deflagration or combustion in the segregated or isolated portion of the first charge 24 and/or that a portion of the second charge 34 could be segregated or isolated from the first initiator device 20 so that operation of the first initiator device 20 would not cause detonation, deflagration or combustion in the segregated or isolated portion of the second charge 34.

In an alternate configuration, the second initiator device 30 could be configured to act on the first initiator device 20 to change the output of the initiator assembly 18 when the first initiator 22 is activated. For example, the second portion 24*b* of the first charge 24 could be formed of a suitable high explosive that is capable of being detonated as well as combusting, the first initiator 22 could be configured to initiate detonation of the first charge 24, and the second initiator device 30 could be configured to initiate combustion of the second portion 24*b* of the first charge 24 (i.e., the second initiator device 30 could be configured to provide a pyrotechnic output to the second portion 24*a* of the first charge 24). In situations where a maximum energy output is required from the initiator system 10, the first initiator 22 can be activated to initiate detonation of the first and second portions 24*a* and 24*b* of the first charge 24 as described above. In situations where a reduced energy output is required from the initiator system 10, the second initiator 32 could be activated to initiate detonation of the second charge 34 (i.e., a charge corresponding to the first portion 34*a* of the second charge 34 in the previous example) and energy released by the detonating second charge 34 can be employed to initiate combustion in the second portion 24*b* of the first charge 24. Since the material that forms the second portion 24*b* of the first charge 24 will combust at a known rate, the first initiator 22 can be activated after a desired time interval to initiate detonation of the first portion 24*a* of the first charge 24. If the energetic material that makes up the second portion 24*b* of the first charge 24 has completely combusted when the first portion 24*a* of the first charge 24 is detonated, the output of the initiator system 10 will be related to the amount of energy that is produced by the detonation of the first portion 24*a* of the first charge 24. However, if the energetic material that makes up the second portion 24*b* of the first charge 24 has not completely combusted when the first portion 24*a* of the first charge 24 is detonated, the output of the initiator system 10 will be related to the amount of energy that is produced by the detonation of the first portion 24*a* of the first charge 24 and a remaining (non-combusted) portion of the second portion 24*b* of the first charge 24.

It will be appreciated that depending on the configurations of the first and second initiator devices 20 and 30 and desired safety objectives, the first and second initiator devices 20 and 30 could be electrically coupled (via the first and second sets of terminals 14 and 16, respectively) to separate firing systems or to same firing system in which the firing system employs a switch mechanism, and/or that the first and second initiator devices 20 and 30 may or may not share a common ground.

It will be appreciated that an initiator that is configured to initiate detonation in a charge need not be an exploding foil initiator but rather could be any other suitable initiator, including an exploding bridge wire initiator. It will also be appreciated that an initiator that is configured to initiate combustion or deflagration in a charge need not include an exploding foil initiator, but rather could be any other suitable initiator, including a squib. It will be further appreciated that while the examples shown and described heretofore have employed first and second initiators 22 and 32 that are oriented to produce respective axial outputs that are parallel to one another, the initiator system 10 could be configured to so that the axial outputs of the first and second initiators 22 and 32 are disposed in a non-parallel manner (e.g., an orientation where the outputs of the first and second initiators 22 and 32 diverge from one another).

While the foregoing examples have employed one initiator device that is configured to produce a detonation or shockwave output and another initiator device that is configured to produce a pyrotechnic output, it will be appreciated that the initiator system 10 could be configured with two or more initiator devices that are each configured to produce a detonation or shockwave output, or that the initiator system 10 could be configured with two or more initiator devices that are each configured to produce a pyrotechnic output.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An initiator system comprising:

a housing having a first charge holder, the first charge holder defining first and second bores;

an initiator assembly received in the housing, the initiator assembly comprising a first initiator device and a second initiator device, the first initiator device comprising a first initiator and a first charge, the second initiator device comprising a second initiator and a second charge, the first bore holding at least a portion of the first charge, the second bore holding at least a portion of the second charge, wherein the portion of the second charge in the second bore is isolated from the portion of the first charge in the first bore;

a first set of initiator terminals received through the housing and electrically coupled to the first initiator; and a second set of initiator terminals received through the housing and electrically coupled to the second initiator;

wherein at least one of the first and second charges is formed of a secondary explosive.

2. The initiator system of claim 1, wherein the first initiator is configured to detonate at least a portion of the first charge when the first initiator is activated.

3. The initiator system of claim 2, wherein the second initiator is configured to detonate at least a portion of the second charge when the second initiator is activated.

4. The initiator system of claim 3, wherein the second initiator comprises an exploding foil initiator.

5. The initiator system of claim 3, wherein the second charge comprises a secondary explosive and a low explosive that is received in a second charge holder to segregate the low explosive portion of the second charge from the secondary explosive portion of the second charge.

6. The initiator system of claim 1, wherein the first initiator comprises an exploding foil initiator.

7. The initiator system of claim 1, wherein the first and second initiators are formed onto a singular, unitarily formed substrate.

8. The initiator system of claim 1, wherein the housing comprises a shell, and a second charge holder, the shell defining a cavity into which the first and second initiator devices, the first charge holder and the second charge holder are received, the second charge holder defining a third bore, a first portion of the second charge being disposed in the second bore, and a second portion of the second charge being disposed in the third bore.

9. The initiator system of claim 8, wherein the second charge holder defines a fourth bore and wherein a portion of the first charge is disposed in the fourth bore.

10. The initiator system of claim 1, wherein either a) the first and second initiators are different from one another, b) the first and second charges are different from one another, or c) the first and second initiators are different from one another and the first and second charges are different from one another.

11. A method for operating an initiator system, the initiator system having a housing and an initiator assembly that is received in the housing, the housing having a first charge holder that defines first and second bores that are segregated from one another, the initiator assembly having a first initiator device and a second initiator device, the first initiator device comprising a first initiator and a first charge, at least a portion of the first charge being disposed in the first bore, the second initiator device comprising a second initiator and a second charge, at least a portion of the second charge being disposed in the second bore, the method comprising:

activating the second initiator to initiate at least one of detonation, combustion and deflagration in the at least the portion of the second charge; and activating the first initiator to initiate detonation of the at least the portion of the first charge;

wherein the first initiator comprises a first exploding foil initiator that has a first bridge and the at least the portion of the first charge is formed of a secondary explosive.

12. The method of claim 11, wherein the second initiator comprises a second exploding foil initiator that has a second bridge.

13. The method of claim 11, wherein the first and second initiators are formed onto a singular, unitarily formed substrate.

14. The method of claim 11, wherein a lag in time of a predetermined duration occurs between activation of the first and second initiators.

15. The method of claim 11, wherein either a) the first and second initiators are different from one another, b) the first and second energetic materials are different from one another, or c) the first and second initiators are different from one another and the first and second energetic materials are different from one another.

16. The method of claim 11, wherein the second initiator is configured to initiate at least one of combustion and deflagration in an output charge portion of the second charge, the output portion being formed of a high explosive, and wherein the first initiator is activated after an amount of time has elapsed since the activation of the second initiator to detonate a portion of the output charge portion that has not combusted and/or deflagrated.

17. The method of claim 16, wherein the amount of time is a predetermined amount of time.

* * * * *